US007926577B2

(12) United States Patent
Thomas et al.

(10) Patent No.: US 7,926,577 B2
(45) Date of Patent: Apr. 19, 2011

(54) METHODS AND APPARATUS FOR SUPPORTING TUBULARS

(75) Inventors: Benson Thomas, Missouri City, TX (US); Karsten Heidecke, Houston, TX (US); Delaney Michael Olstad, Clear Lake, TX (US); Michael Hayes, Houston, TX (US); Doyle Frederic Boutwell, Jr., Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 80 days.

(21) Appl. No.: 12/208,157

(22) Filed: Sep. 10, 2008

(65) Prior Publication Data

US 2010/0059231 A1 Mar. 11, 2010

(51) Int. Cl.
*E21B 19/10* (2006.01)

(52) U.S. Cl. ..... 166/380; 175/423

(58) Field of Classification Search ..... 166/77.51, 166/77.52, 77.53, 379, 380, 381; 294/102.2; 175/423

See application file for complete search history.

(56) References Cited

U.S. PATENT DOCUMENTS

| | | | | |
|---|---|---|---|---|
| 2,068,217 | A | 1/1937 | Abegg | |
| 3,270,389 | A | 9/1966 | Kingsbury | |
| 3,579,752 | A * | 5/1971 | Brown | 188/67 |
| 3,742,562 | A | 7/1973 | Haby | |
| 3,999,260 | A * | 12/1976 | Stuckey et al. | 81/57.19 |
| 4,306,339 | A * | 12/1981 | Ward | 188/67 |
| 4,332,062 | A * | 6/1982 | Byrne, Jr. | 188/67 |
| 4,355,443 | A * | 10/1982 | Blackwell | 188/67 |
| 4,681,193 | A * | 7/1987 | Crowe | 188/67 |
| 6,640,939 | B2 * | 11/2003 | Buck | 188/67 |
| 6,892,835 | B2 | 5/2005 | Shahin et al. | |
| 7,337,853 | B2 * | 3/2008 | Buytaert et al. | 166/381 |
| 7,395,855 | B2 * | 7/2008 | Ayling | 166/77.52 |
| 2003/0164276 | A1 * | 9/2003 | Snider et al. | 192/70.27 |
| 2006/0137884 | A1 * | 6/2006 | Torres | 166/380 |
| 2006/0254866 | A1 | 11/2006 | Shahin | |
| 2007/0209804 | A1 | 9/2007 | Webre et al. | |
| 2008/0105463 | A1 | 5/2008 | Adams et al. | |
| 2008/0264650 | A1 * | 10/2008 | Begnaud et al. | 166/381 |
| 2009/0057032 | A1 * | 3/2009 | Angelle et al. | 175/423 |

OTHER PUBLICATIONS

EP Search Report for Application No. 09169362.2-1266 dated Jan. 22, 2010.

Australian Office Action for Patent Application No. 2009212960 dated Aug. 19, 2010.

* cited by examiner

*Primary Examiner* — William P Neuder
*Assistant Examiner* — Blake Michener
(74) *Attorney, Agent, or Firm* — Patterson & Sheridan, LLP

(57) ABSTRACT

Embodiments of the invention relate to a gripping apparatus for supporting a tubular. The gripping apparatus may include a housing, a slip assembly disposed in the housing, and a leveling ring operable to move the slip assembly in the housing. The gripping apparatus may further include a guide member and a mating member operable to couple the slip assembly to the leveling ring. The longitudinal movement of the leveling ring directs the mating member along the guide member to radially displace the slip assembly relative to the housing.

26 Claims, 17 Drawing Sheets

METHODS AND APPARATUS FOR SUPPORTING TUBULARS

BACKGROUND OF THE INVENTION

1. Field of the Invention

Embodiments of the invention generally relate to a gripping apparatus for supporting tubulars. In particular, embodiments of the invention relate to a gripping apparatus disposable within a rotary table and having a slip assembly for gripping tubulars that is operable using a leveling ring. Additional embodiments of the invention relate to a control line guide assembly for protecting control lines in use with the supported tubulars.

2. Description of the Related Art

The handling of pipe strings has traditionally been performed with the aid of a spider. Typically, spiders include a plurality of slips circumferentially surrounding the exterior of the pipe string. The slips are housed in what is commonly referred to as a "bowl." The bowl is regarded to be the surfaces on the inner bore of the spider. The inner sides of the slips usually carry teeth formed on hard metal dies for engaging the pipe string. The exterior surface of the slips and the interior surface of the bowl have opposing engaging surfaces which are inclined and downwardly converging. The inclined surfaces allow the slips to move vertically and radially relative to the bowl. In effect, the inclined surfaces serve as camming surfaces for engaging the slips with the pipe. Thus, when the weight of the pipe is transferred to the slips, the slips will move downwardly with respect to the bowl. As the slips move downward along the inclined surfaces, the inclined surfaces urge the slips to move radially inward to engage the pipe. In this respect, this feature of the spider is referred to as "self tightening." Further, the slips are designed to prohibit release of the pipe string until the pipe load is supported by another means.

Traditionally, a spider is located above a rotary table situated in the rig floor. More recently, flush mounted spiders have been developed so that the spider does not intrude upon the work deck above the rotary. Because flush mounted spiders reside within the rotary table, the pipe size handling capacity of the spider is limited by the size of the rotary table. Current spider designs further augment the problem of limited pipe size handling capacity. Thus, in order to handle a larger pipe size, a larger rotary table must be used. However, the process of replacing the existing rotary table is generally economically impractical.

This pipe size handling capacity problem has been further complicated with the advent of intelligent completion systems. Improvements in technology now allow wellbores to be equipped with sensors, gauges, and other electronic devices that can be used to monitor various wellbore characteristics such as temperature, pressure, flow rate, etc. Additionally, downhole tools can be controlled remotely from the well surface or at some other remote location. However, to communicate with such devices and tools, these intelligent systems require multiple control lines that are run from the well surface to these downhole components with the pipe string. Accommodations must be made to make sure that these control lines are not pinched or damaged by the setting of the slips during makeup or breakup of the pipe string.

Another problem of some spiders currently in use is that many pipe joints may include coatings, for example to prevent corrosion, requiring higher downward forces to ensure positive slip engagement with the pipe joints. Further, in many completion operations the maximum height of the spider is limited by a connection height due to the length of the pipe joints. Further still, the slips are generally held in position in the bowl by friction, resulting in a limited amount of torque that may be applied to the pipe joints before slippage occurs between the slips and the bowl.

There is a need, therefore, for an improved gripping apparatus to address and overcome the problems described above.

SUMMARY OF THE INVENTION

Embodiments of the invention relate to a gripping apparatus for supporting a tubular. The gripping apparatus may include a housing, a slip assembly disposed in the housing, and a leveling ring operable to move the slip assembly in the housing. The gripping apparatus may further include a guide member and a mating member operable to couple the slip assembly to the leveling ring. The longitudinal movement of the leveling ring directs the mating member along the guide member to radially displace the slip assembly relative to the housing.

Embodiments of the invention relate to a gripping apparatus for supporting a tubular. The gripping apparatus may have a housing and a slip assembly disposed in the housing. The slip assembly may include a slip bracket that is used to radially project and retract the slip assembly relative to the housing. The gripping apparatus may include a leveling ring having a slot and a pin. The pin is disposed through the slot and the slip bracket so that vertical displacement of the leveling ring moves the pin along the slot, thereby moving the slip bracket to radially project and retract the slip assembly relative to the housing.

Embodiments of the invention relate to a gripping apparatus for supporting a tubular. The gripping apparatus may comprise a housing and a slip assembly disposed in the housing that includes a slip bracket. The gripping apparatus may further include a displacement member coupled to the slip bracket. A longitudinal displacement of the displacement member relative to the housing allows the slip bracket to move the slip assembly a lateral distance that is greater than the longitudinal displacement of the displacement member.

In one embodiment, the housing comprises a shoulder having an incline along which the slip assembly travels. A ratio of a lateral length and a vertical height defined by the incline is less than a ratio defined by the lateral distance that the slip assembly moves and the longitudinal displacement that the displacement member moves.

Embodiments of the invention relate to a method for supporting a tubular using a gripping apparatus. The method may comprise the step of providing the tubular through the gripping apparatus. The gripping apparatus includes a housing, a slip assembly disposed in the housing, and a leveling ring operable to actuate the slip assembly. The method may further comprise the step of actuating the leveling ring to actuate the slip assembly, wherein a longitudinal displacement of the leveling ring relative to the housing allows the slip assembly to move a lateral distance that is greater than the longitudinal displacement of the leveling ring. The method may further comprise the step of engaging the tubular using the slip assembly.

In one embodiment, the housing comprises a shoulder having an incline along which the slip assembly travels. A ratio of a lateral length and a vertical height defined by the incline is less than a ratio defined by the lateral distance that the slip assembly moves and the longitudinal displacement that the displacement member moves.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
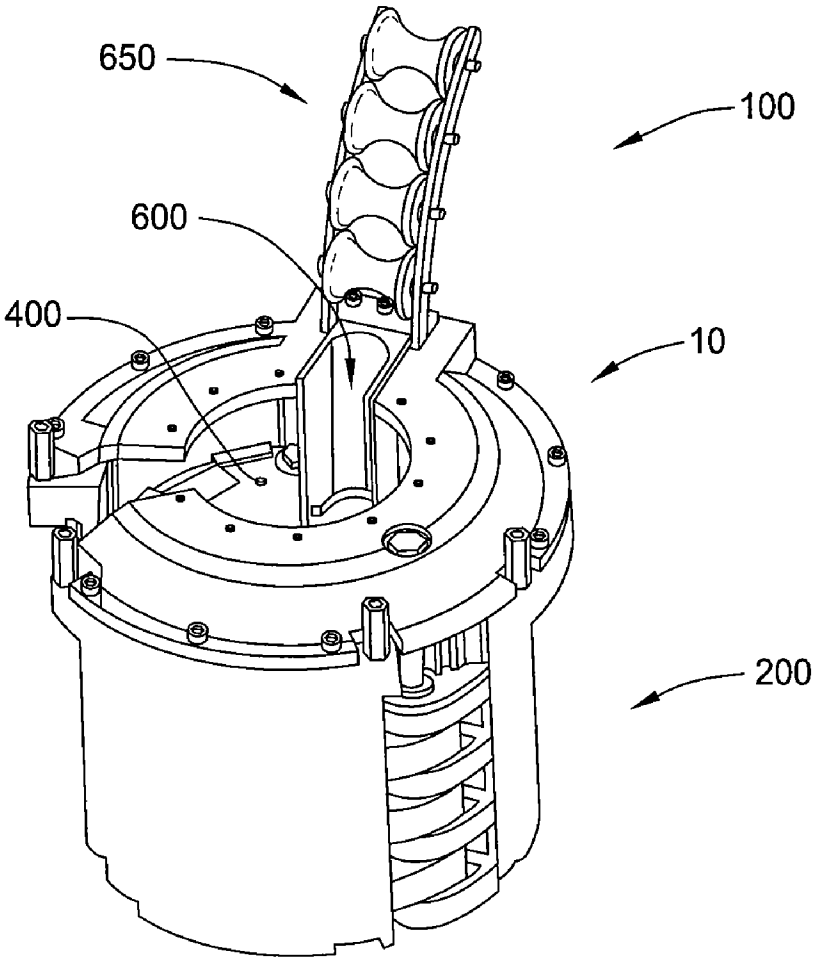
FIG. 1A illustrates a spider according to one embodiment of the invention.

FIG. 1A illustrates a gripping apparatus 100 according to one embodiment of the invention. As illustrated, the gripping apparatus 100 comprises a spider 100 that may be flush mountable and disposable within a rotary table (not shown). The spider 100 includes a cover assembly 10 coupled to a housing 200 for housing a slip assembly 300 (shown in FIG. 3), a leveling ring 400, and a control line guide assembly 600, and a control line support 650. In one embodiment, the control line support 650 includes a plurality of rollers disposed along a track.

As shown, the cover assembly 10 is attached to the top of the housing 200, such as with bolts, and includes an opening disposed through the center that coincides with the center of the housing 200 for receiving tubulars. The cover assembly 10 may comprise two separate sections to allow the housing 200 to open and close without removing the cover assembly 10. The cover assembly 10 may be used to protect the internal assemblies of the spider 100.

Figure 1B:
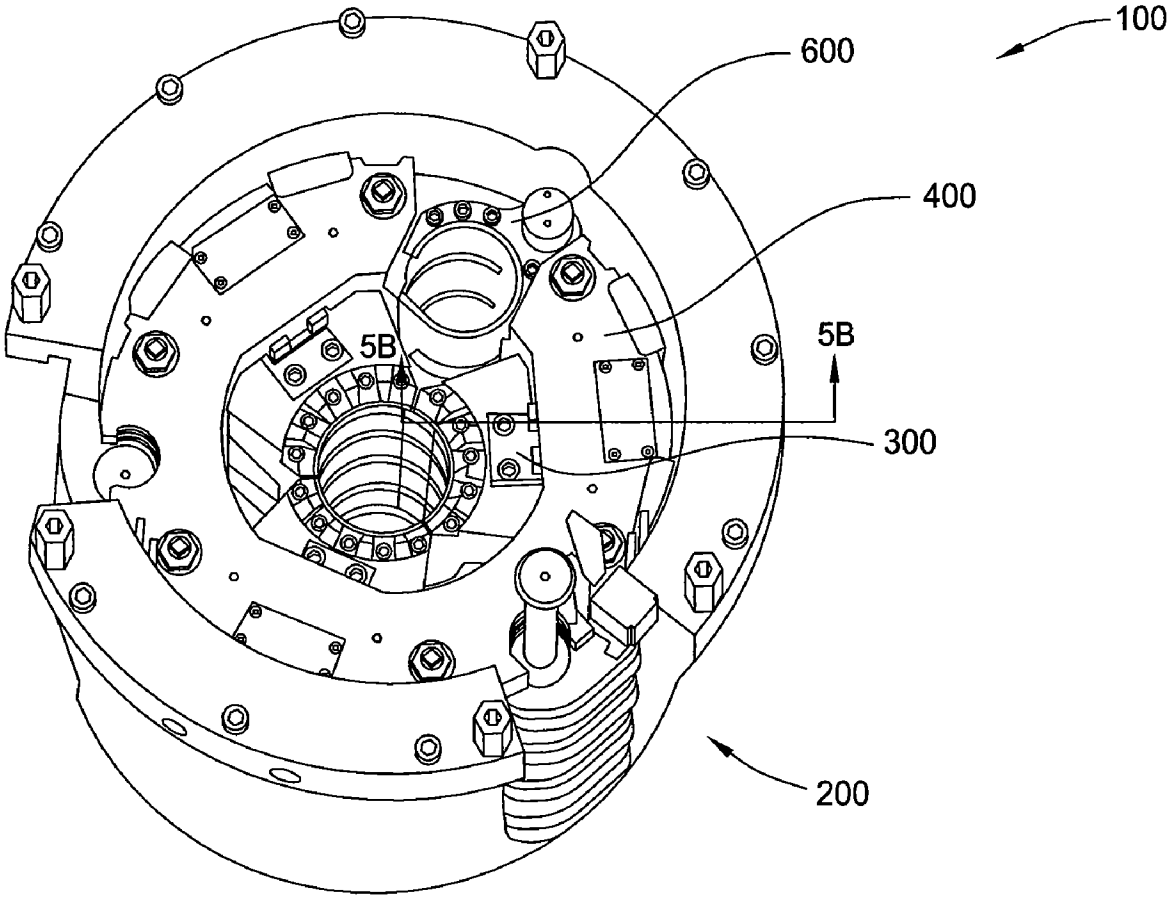
FIG. 1B illustrates the internal assemblies of the spider according to one embodiment of the invention.

FIG. 1B illustrates the gripping apparatus 100 with the cover assembly 10 removed from the housing 200. As illustrated, slip assembly 300 is disposed within and surrounded by the housing 200. The slip assembly 300 is operable between a set and setback position for gripping and releasing a tubular located though the center of the spider 100. To actuate the slip assembly 300, the leveling ring 400 is coupled to the slip assembly 300 and is movable in a vertical direction, via a piston/cylinder arrangement for example, to actuate the slip assembly 300. Also disposed through the housing 200 and located adjacent the slip assembly is the control line guide assembly 600, which may be used to protect and retain control lines that are raised from and/or lowered into a wellbore along with a tubular. The control line guide assembly 600 is operable between an open and closed position to allow the introduction and removal of the control lines, as subsequent tubulars are run through the spider 100. In this manner, the control lines may be protected from being damaged, such as by being crimped or pinched by the slip assembly 300, as the spider 100 grips and releases engagement with tubulars.

Figure 2B:
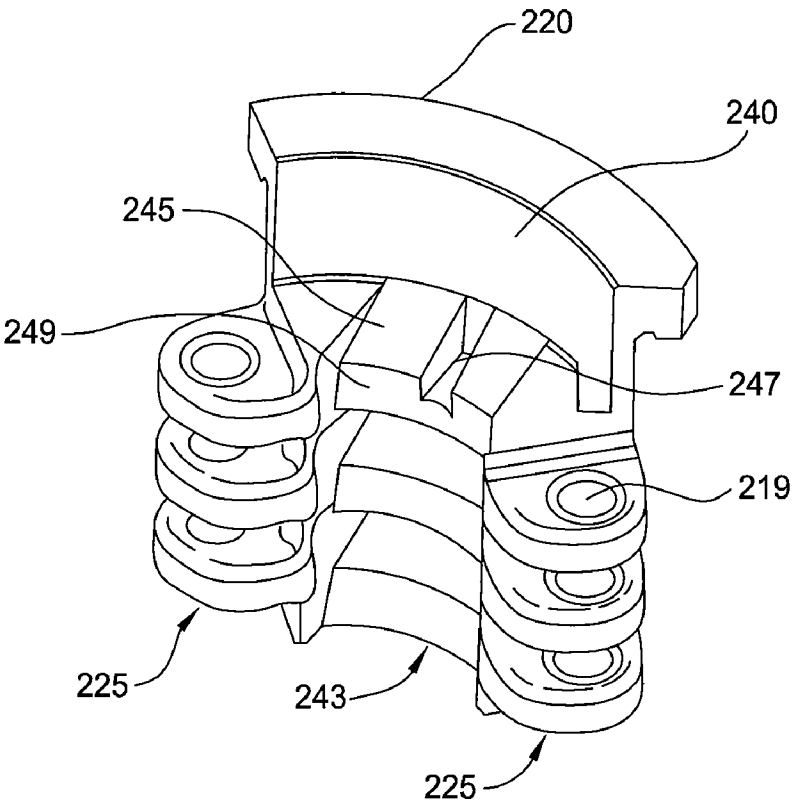
FIGS. 2A and 2B illustrate a housing of the spider according to one embodiment of the invention.
Figure 2A:
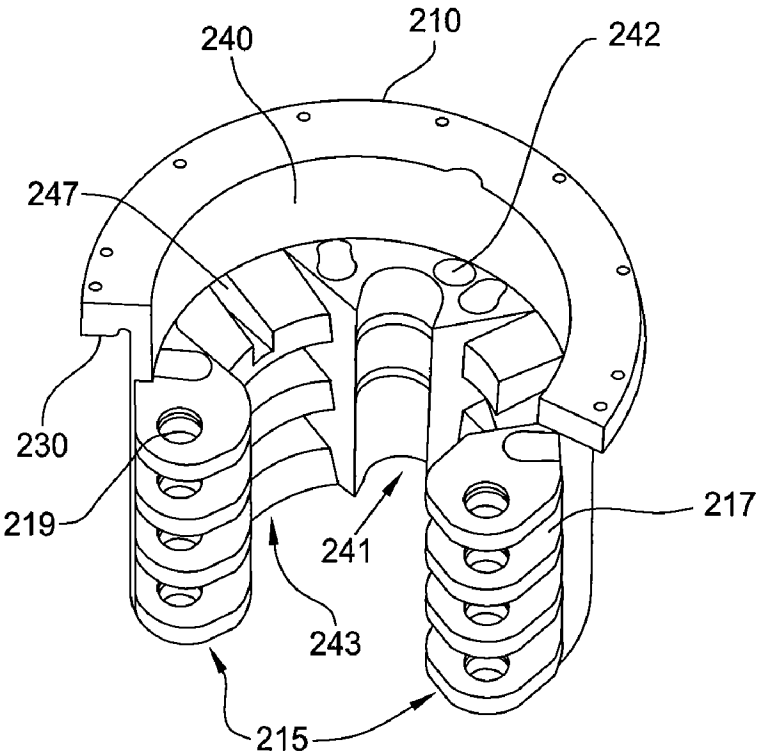

FIGS. 2A and 2B illustrate a body 210 and a door 220, respectively, of the housing 200. The spider 100 is formed by pivotally coupling the body 210 and the door 220 using one or more connectors 215 and 225, such as hinges, formed on both sides of the body 210 and the door 220, respectively. In an alternative embodiment, the body 210 and the door 220 may be hinged on one side and selectively locked together on the other side. The housing 200 includes a bowl 240 that extends vertically through a lower portion of the body 210 and the door 220 to house the slip assembly 300.

The housing 200 includes a flange 230 formed on an upper portion of the body 210 and the door 220 for connection to the cover assembly 10 and for mounting the spider 100 in a rotary table. Other ways of mounting the spider 100 in the rotary table and of connecting the cover assembly 10 are also contemplated. It is further contemplated that the spider 100 may also be secured within the rotary table to prevent relative rotation between the spider and the rotary table, such as with one or more key/slot arrangements. One or more connectors 215 are formed on each side of the body 210 and one or more connectors 225 are formed on each side of the door 220. A gap 217 exists between each connector 215 for mating with the connectors 225 formed on the door 220. A hole 219 is formed through each connector 215 and 225 to accommodate a pin. The holes 219 of the connectors 215 and 225 are aligned so that the pin may be disposed through the holes 219 to secure the body 210 to the door 220.

The interior of the bowl 240 may include a control line recess 241 located adjacent an actuator slot 242, and shoulders 243 radially extending from the inner surface of the bowl 240. The control line recess 241 is adapted to receive control lines that are being raised and/or lowered with a tubular and to protect the control lines as the tubular is being supported by the spider 100. The actuator slot 242 is located adjacent the control line recess 241 and is adapted to house an actuator (shown in FIG. 6) that is operable to open and close communication with the control line recess 241.

As illustrated, the bowl 240 includes three sets of shoulders 243, two sets on the body 210 and one set on the door 220, each set having three shoulders spaced apart vertically. Each shoulder 243 may include an angled top surface 245 and an angled side surface 249 along which the slip assembly 300 may travel into a set and a setback position. The shoulders 243 are positioned to place the slip assembly 300 further away from the center of the spider 100, thereby creating a larger inner diameter to accommodate larger sized pipes. In addition, the shoulders 243 are positioned to place the slip assembly 300 closer to the center of the spider 100, thereby creating a smaller inner diameter to accommodate smaller sized pipes.

In another aspect, the uppermost shoulder 243 of each set may include a slot 247 for guiding the axial movement of the slip assembly 300 along the shoulder 243. The slots 247 may mate with a key formed on the outer surface of the slip assembly 300 to maintain the path of the moving slip assembly 300 and prevent the slip assembly 300 from rotating relative to the housing 200. Because the slip assembly 300 cannot rotate within the housing 200 and the housing 200 may be rotatively secured within the rotary table, the spider 100 may be used to apply a back up torque during the make up or break out of tubular connections.

Figure 3A:
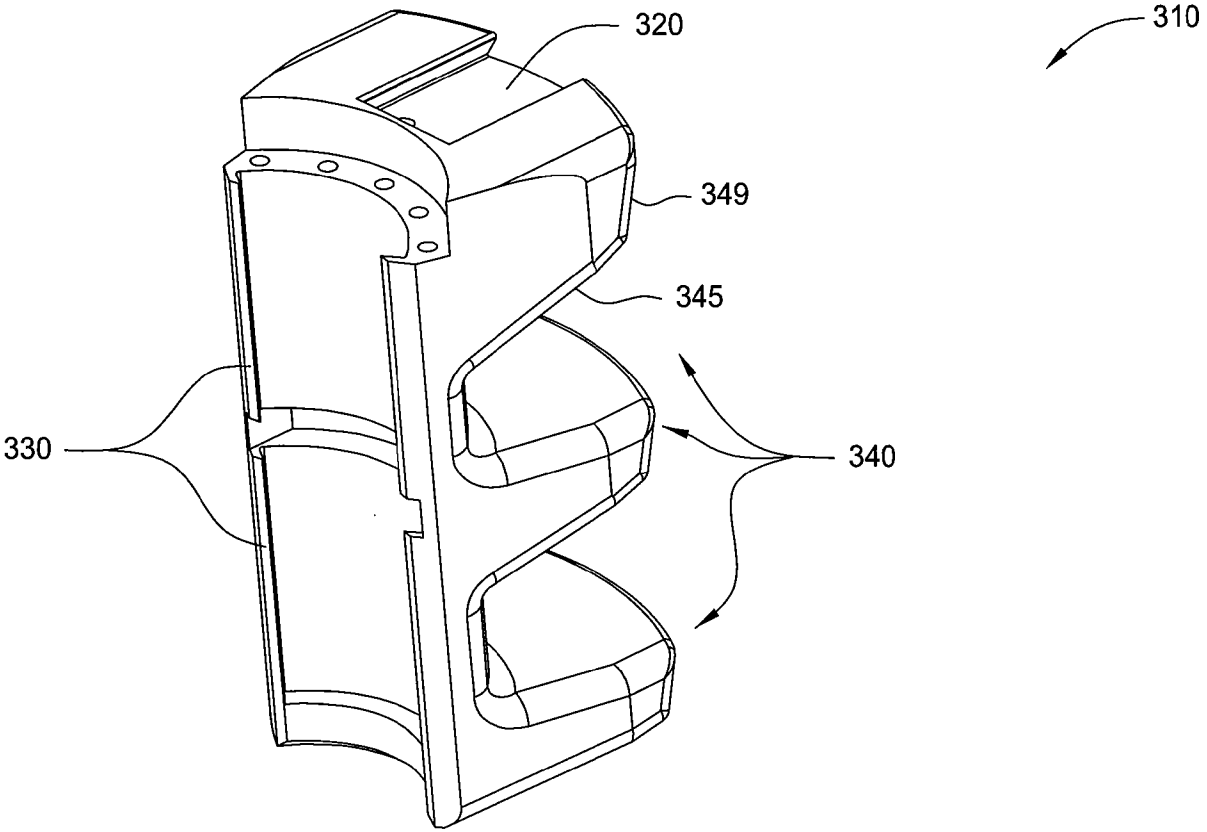
FIGS. 3A, 3B, and 3C illustrate a slip assembly of the spider according to one embodiment of the invention.
Figure 3B:
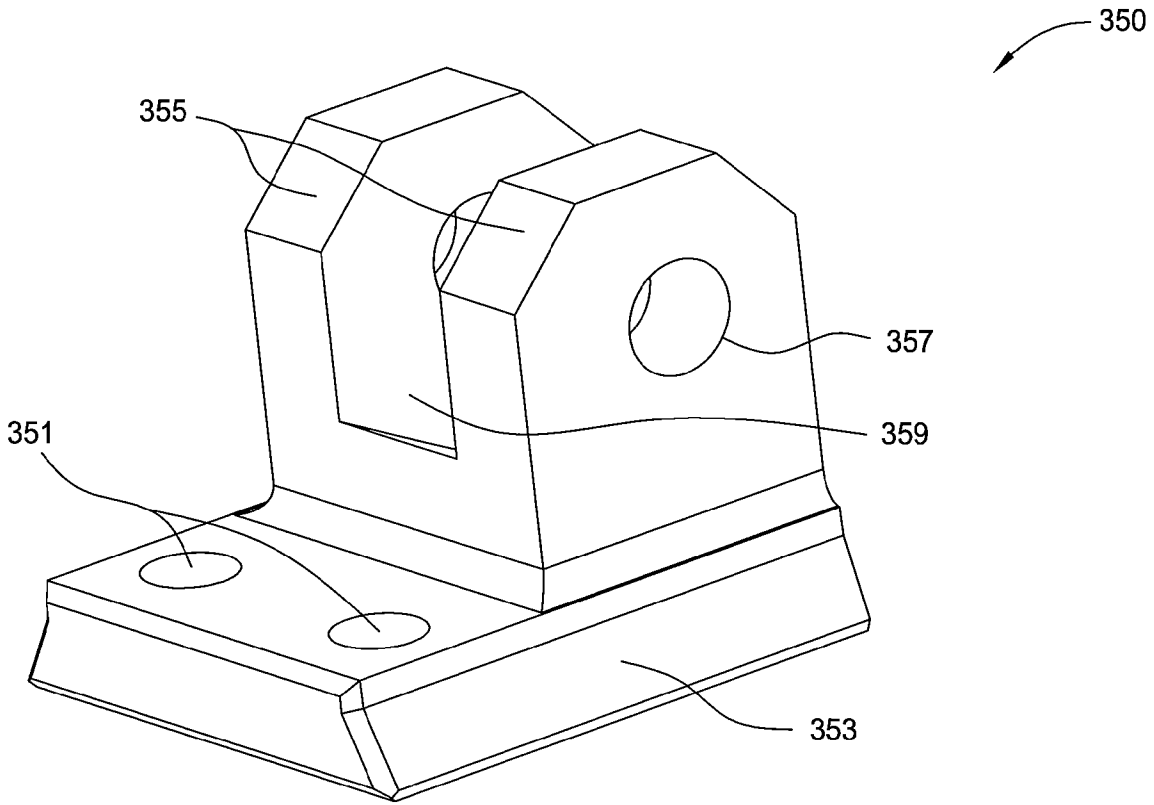
Figure 3C:
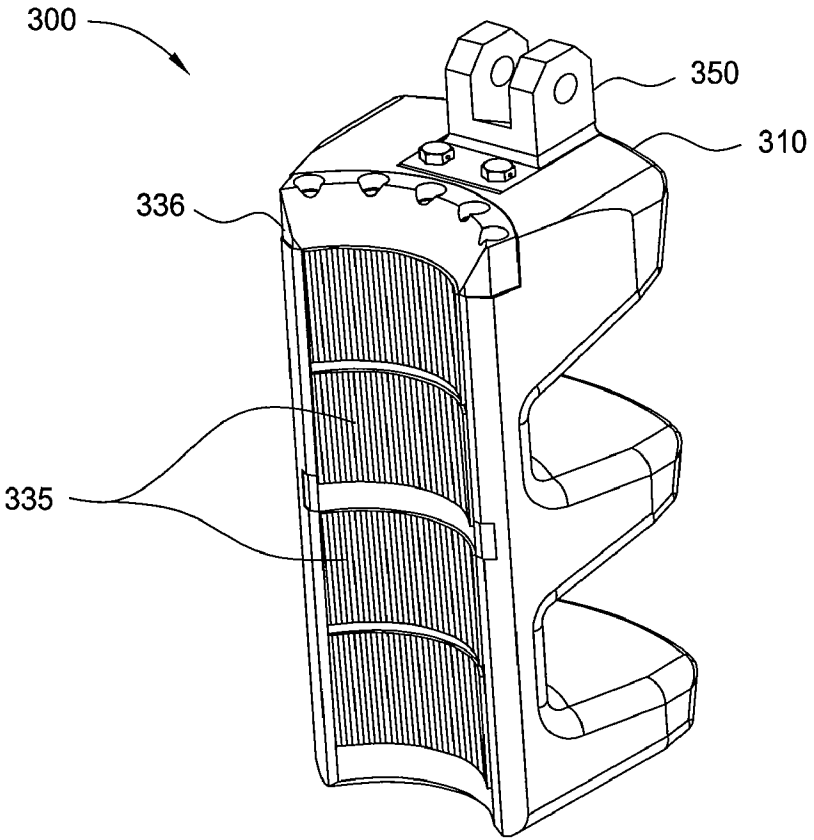

FIGS. 3A-3C illustrate the slip assembly 300. The slip assembly 300 includes a slip body 310 adapted to retain a plurality of gripping elements 335 (as shown in FIG. 3C), such as dies, and includes a slip bracket 350. The slip body 310 includes a slot 320, slip retainers 330, and shoulders 340. The slot 320 is disposed in the top portion of the slip body 310 and includes an open end adapted to receive the slip bracket 350. The slot 320 may also include a dovetail groove or inwardly tapering sidewalls, such that upon horizontal insertion of the slip bracket 350 into the open end of the slot 320, the slip bracket 350 is prevented from being vertically displaced relative to the slip body 310. The slip retainers 330 include slots along the slip body 310, opposite the shoulders 340, which are adapted to receive and retain the gripping elements 335 to the slip body 310. The gripping elements 335 may be secured in the slip retainers 330 using a retainer 336 bolted to the slip body 310 above the gripping elements (as shown in FIG. 3C). In this manner, the dies are removable and easily replaceable from the slip body 310. The gripping elements 335 rest on horizontal load bearing plates to evenly distribute any load received by the gripping elements 335 and to prevent stress concentrations on the slip body 310. As shown in this embodiment, the slip assembly 300 also includes three shoulders 340 adapted to mate with one set of the shoulders 243 of the housing 200. Specifically, each shoulder 340 includes an angled bottom surface 345 and an angled side surface 349, operable to engage the top surfaces 245 and side surfaces 249, respectively, of the housing 200 to facilitate movement of the slip assembly 300 within the spider 100.

FIG. 3B illustrates the slip bracket 350, which couples the slip assembly 300 to the leveling ring 400. The slip bracket 350 includes a base 353, which is received into the slot 320, a pair of supports 355 having a channel 359 disposed therebetween, and openings 357 disposed through the supports 355 for securing the slip bracket 350 to the leveling ring 400. Openings 351 may also be located in the base 353 to retain the slip bracket 350 in the slot 320 using pins or bolts (as shown in FIG. 3C). The channel 359 includes an angled surface adapted to engage a corresponding surface on the leveling ring 400, as further described below, along which the leveling ring 400 may slide to transmit a force to actuate the slip assembly 300.

In one embodiment, three slip assemblies 300 are disposed in the housing 200 and uniformly coupled to the leveling ring 400. In one embodiment, each slip assembly 300 is individually replaceable. In one embodiment, the slip bracket 350 may be formed as an integral part of the slip assembly 300, such as integral with the slip body 310.

Figure 4A:
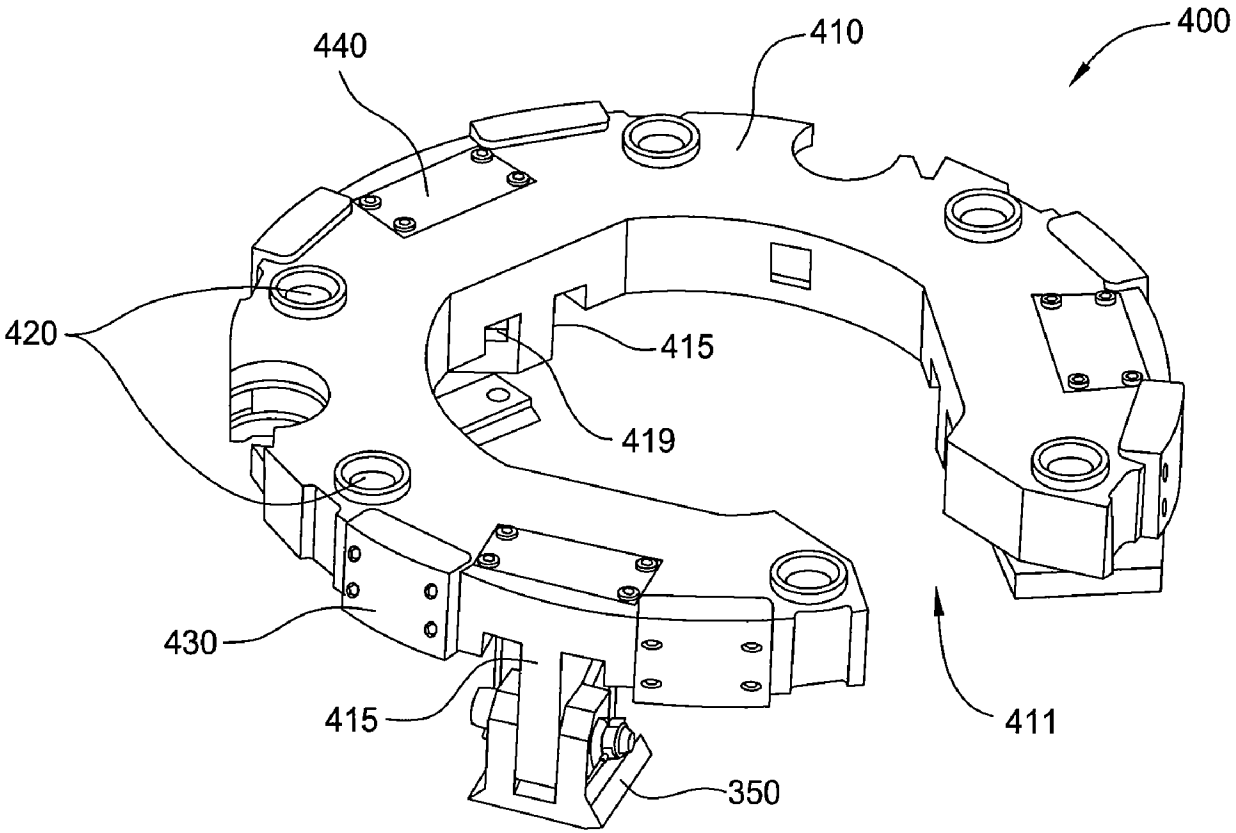
FIGS. 4A, 4B, 4C, and 4D illustrate a leveling ring of the spider according to one embodiment of the invention.

FIG. 4A illustrates a displacement member, such as the leveling ring 400 for connecting multiple slip assemblies 300 and synchronizing their movement. The leveling ring 400 includes a ring body 410 having an opening disposed through the center of the body that coincides with the center of the spider 100, and a gap 411 that coincides with the control line recess 241 in the housing 200 to provide the control lines unhindered access to the control line recess 241. One or more retention assemblies 420 (further shown in FIG. 4D) of the leveling ring 400 extend through the ring body 410 for housing and securing another displacement member, such as a rod 429 to the ring body 410 that is used to raise and lower the leveling ring 400 via a piston/cylinder arrangement for example. The leveling ring 400 also includes guides 430 that may be used to direct the vertical movement of the leveling ring 400 and prevent the leveling ring 400 from rotating relative to the housing 200. The guides 430 may be spaced apart around the circumference of the ring body 410.

Figure 4B:
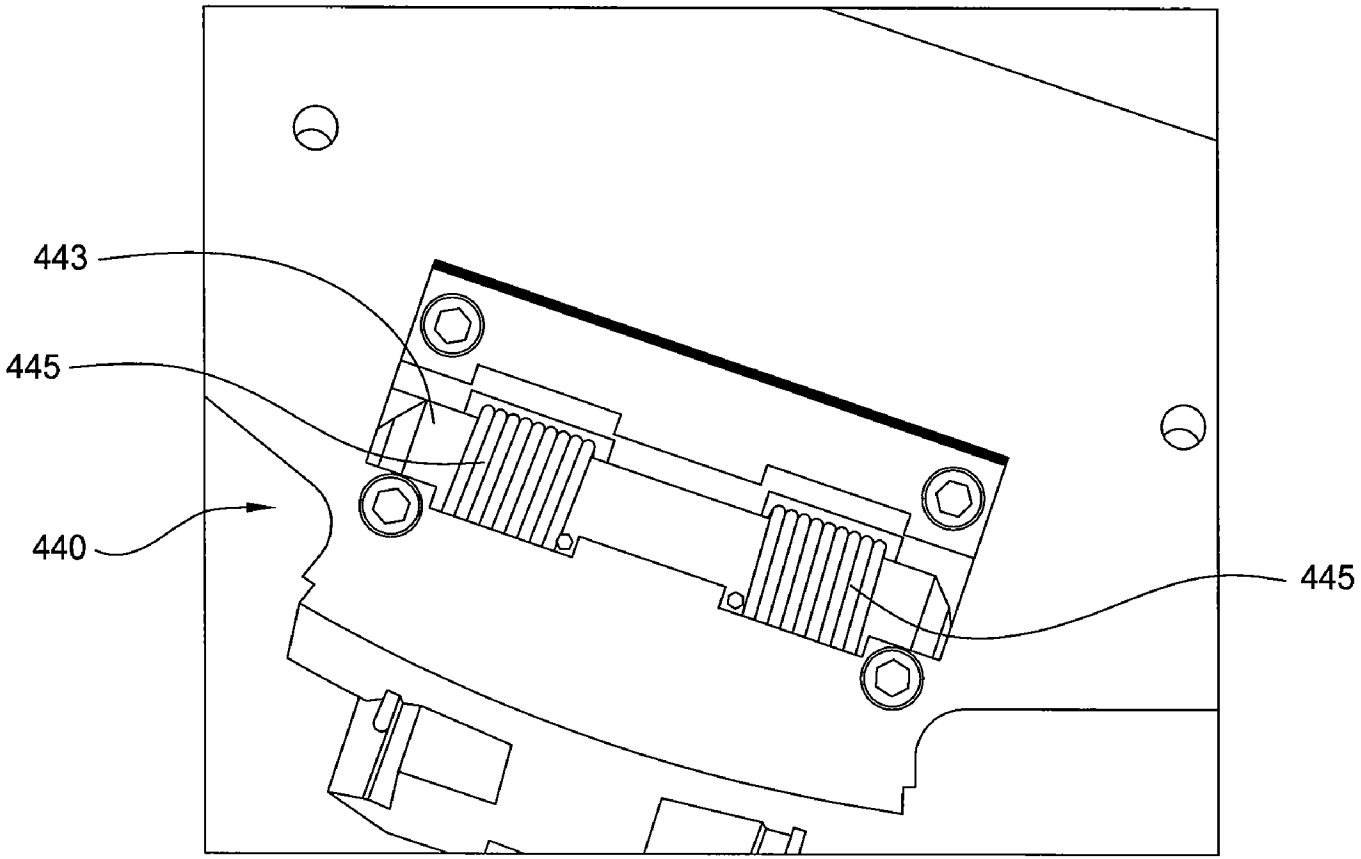
Figure 4C:
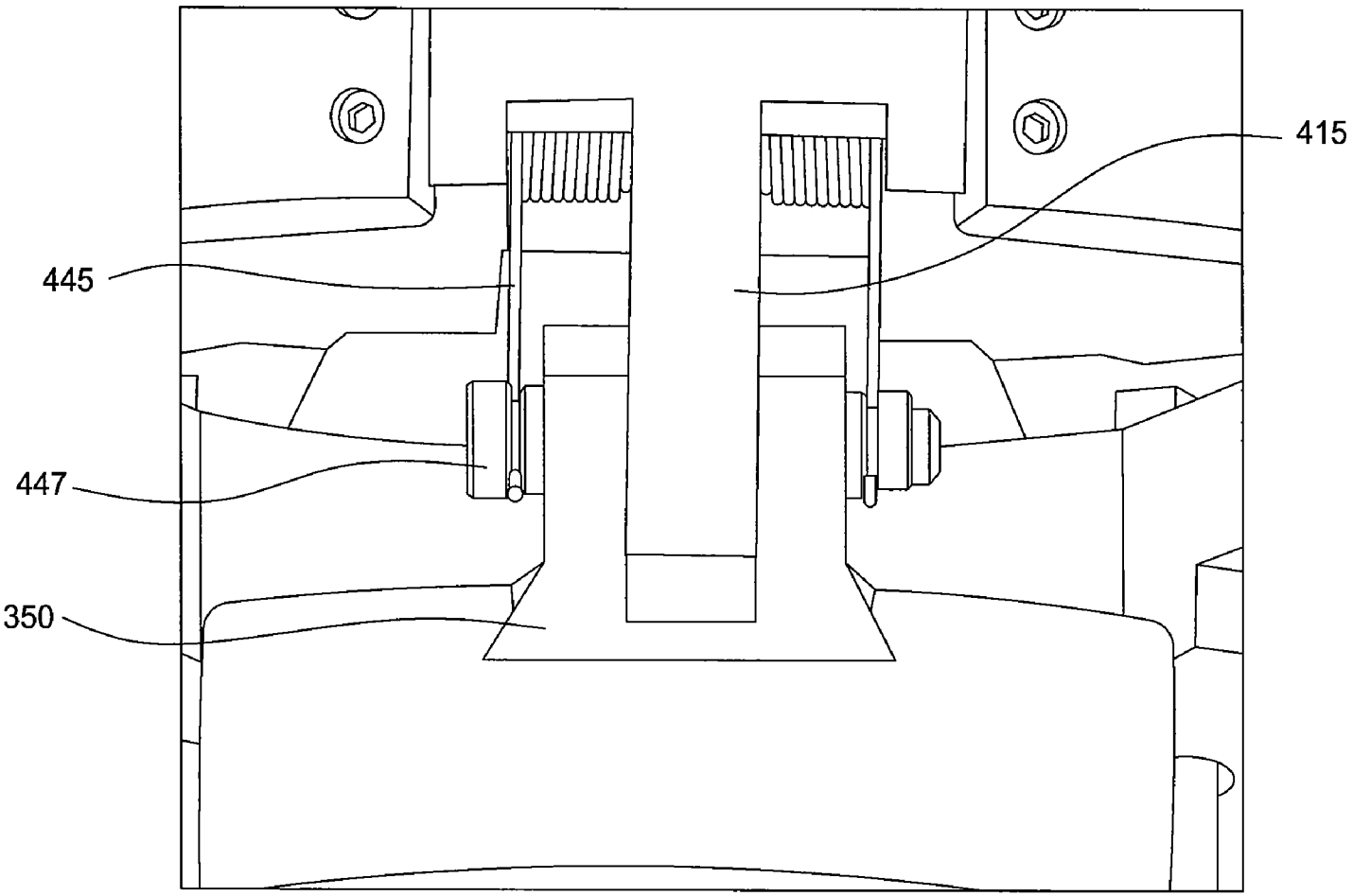

The leveling ring 400 further includes one or more spring assemblies 440 housed in the ring body 410, as illustrated in FIG. 4B, for helping retain the slip assembly 300 in a setback position. Each spring assembly 440 includes a spring rod 443 secured in the ring body 410 and one or more biasing members, such as torsion springs 445 disposed around the spring rod 443. As illustrated in FIG. 4C, each torsion spring 445 includes an end portion that extends around a mating member 447, such as a slip pin 447 that couples the slip assembly 300 to the leveling ring 400. The slip pin 447 is disposed through the supports 355 of the slip bracket 350 and a slot 419 a guide member 415 extending from the ring body 410, which is received between the supports 355 and along the channel 359 of the slip bracket 350, thereby coupling the ring body 410 to the slip body 310. The torsion springs 445 provide a constant positive force to the slip pin 447, forcing the slip pin 447 in one direction along the slot 419 of the guide member 415, thereby facilitating movement of the slip assembly 300 via the slip bracket 350 to the setback position.

In one embodiment, the guide member 415 may project from a recess formed in the bottom of the ring body 410 and may include an angled bottom surface from the center of the leveling ring 400 to its outer diameter. The guide member 415 may be operable to engage the channel 359 of the slip bracket 350 and may be disposed between the supports 355 of the slip bracket 350 when coupled to the slip bracket 350 by the slip pin 447. The bottom surface of the guide member 415 may be angled to correspond with the channel 359 of the slip bracket 350. The slot 419 in the guide member 415 may also be angled generally extending from the center of the leveling ring 400 to its outer diameter within the guide member 415. The slip pin 447 travels along the slot 419 of the guide member 415 when the leveling ring 400 is actuated to move the slip assembly 300 via the slip bracket 350.

In operation, as the leveling ring 400 is actuated, the engagement between the slip bracket 350 and the guide member 415 may provide the spider 100 with a large slip assembly 300 setback. The engagement between the slip bracket 350 and the guide member 415 allows the spider 100 to handle a large range of tubular diameters, including relatively larger diameter tubulars, using the large slip assembly 300 setback, without any significant increase in the height of the tool. The spider 100 is configured to fit within a standard rotary table, such as a 37½ inch rotary table that is disposed in a rig floor, while remaining substantially flush with the surface of the rig floor.

In an alternative embodiment, the guide member 415 may be formed as a part of or attached to the slip assembly 300. The guide member 415 may have a slot 419 along which a pin 447 of the leveling ring 400 travels to radially displace the slip assembly 300. When the leveling ring 400 is actuated, the slip assembly 300 is radially displaced to provide a large set back of the slip assembly 300, as discussed herein.

Figure 4D:
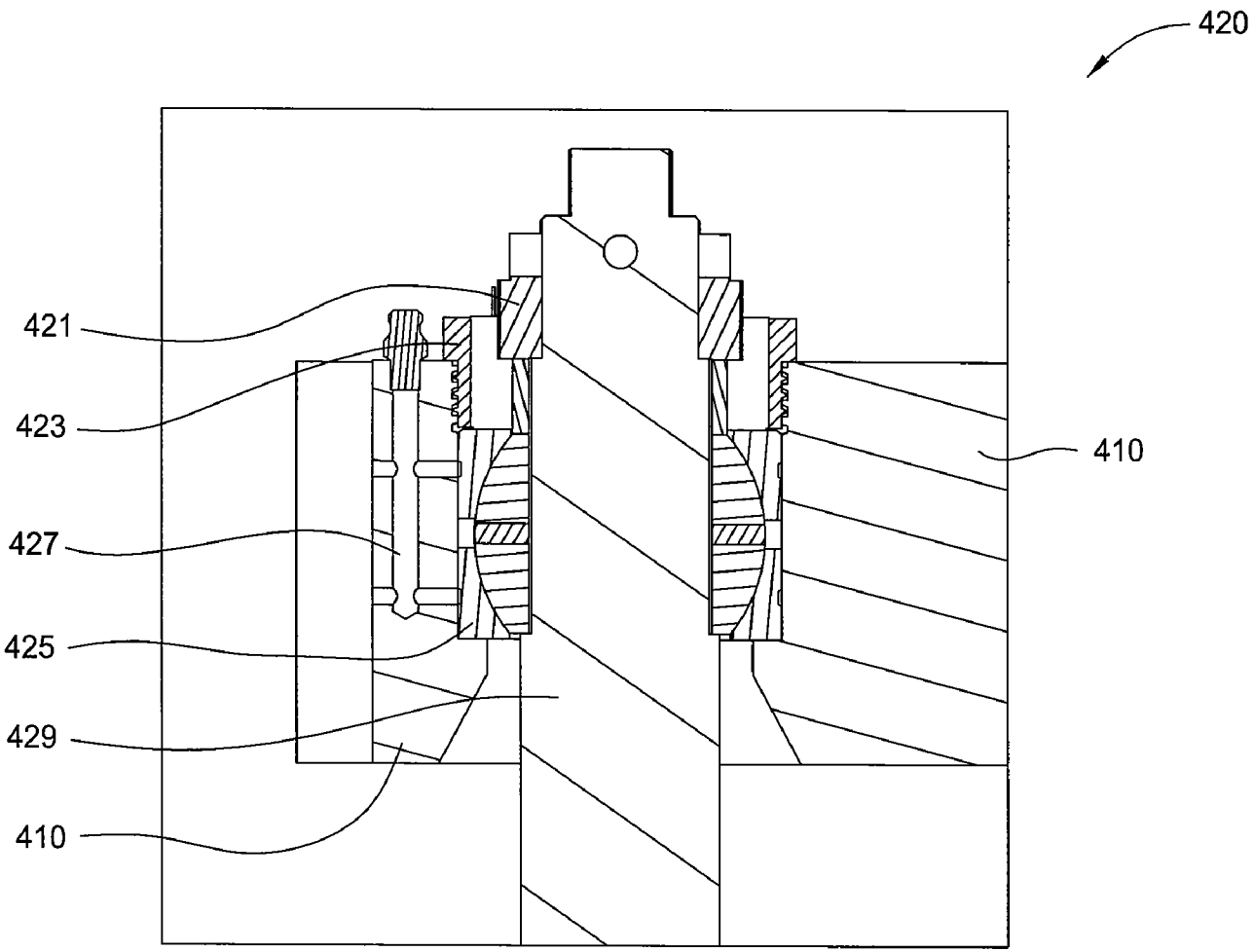

FIG. 4D illustrates a cross sectional view of the retention assembly 420. One or more retention assemblies 420 may be spaced apart around the circumference of the ring body 410 (as shown in FIG. 4A). Each retention assembly 420 includes a rod connection 421, for example a nut and pin, a retention cap 423 coupled to the ring body 410 to retain a bearing assembly 425 within the ring body 410, and lubrication paths 427 for providing a lubrication fluid to the bearing assembly 425. The rod connection 421 may be used to couple the rod 429, which is disposed through the ring body 410 and the bearing assembly 425, to the ring body 410 and retain the rod 429 within the bearing assembly 425. As the rod 429 is actuated a vertical direction, by a piston/cylinder arrangement for example, the ring body 410 is moved along with the rod 429 via the retention assembly 420 to actuate the slip assembly 300 in the set and setback positions.

The bearing assembly 425 surrounds the rod 429 and is located within the ring body 410, and is further in communication with the lubrication paths 427, such that a lubrication fluid may be supplied to the bearing assembly 425 to lubrication the retention assembly 420. The bearing assembly 425 may include an outer housing and a bearing that is rotatably mounted within the housing. The rod 429 may tilt relative to a horizontal axis of the ring body 410 using the bearing. As the rod 429 is actuated in a vertical movement, the ring body 410 may be substantially uniformly moved in the vertical direction by use of the bearing assembly 425, which may compensate for any non-uniform vertical movement of the one or more rods 429 when directing the leveling ring 400 or the leveling ring 400 when directing the slip assembly 300.

Figure 5A:
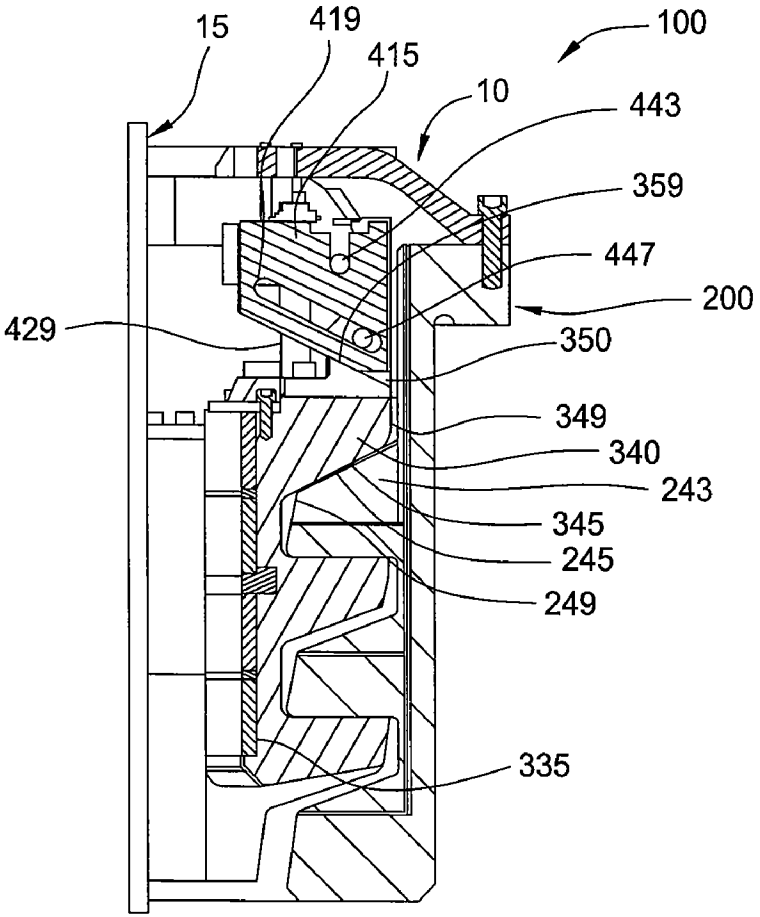
FIG. 5A illustrates the spider in a setback position according to one embodiment of the invention.

FIG. 5A illustrates a cross sectional view of the spider 100 in the setback position, located in the housing 200. A side of the tubular 15 disposed through the housing 200 and is shown for illustrating the relative locations of a tubular and the slip assembly 300 in the spider 100. As illustrated, the leveling ring 400 is raised to about an uppermost point via the one or more rods 429. As the leveling ring 400 is raised, the slip pin 447 is directed along and laterally displaced to the lower end of the slot 419 in the guide member 415 of the ring body 410, thereby laterally displacing the slip bracket 350 and retracting the slip assembly 300 to the setback position. The bottom surface of the guide member 415 of the ring body 410 may also engage the channel 359 of the slip bracket 350 to facilitate lateral movement of the slip bracket 350 relative to the leveling ring 400. Assisting the movement of the slip pin 447 in this direction is the torsion spring 445, as described above, which is disposed around the spring rod 443 at one end and provides a positive force on the slip pin 447 to facilitate setting back of the slip assembly 300. As the slip assembly 300 is radially retracted, the shoulders 340 of the slip assembly 300 engage and slide along the shoulders 243 of the housing 200. Specifically, starting from the set position, the side surfaces 349 of the shoulders 340 engage and slide up the side surfaces 249 of the corresponding shoulders 243 of the housing 200 until they reach the top surfaces 245. Then the bottom surfaces 345 of the shoulders 340 travel up along the top surfaces 245 of the corresponding shoulders 243 to the setback position. The contours of the shoulders 340 of the slip assembly 300 correspond with the contours of the shoulder 243 of the housing 200 to allow substantial retraction of the slip assembly 300 from the center of the spider 100, such as from engagement with the tubular 15. This function helps increase the range of tubular sizes that the spider 100 may be used to grip and release.

In one embodiment, only the bottom surface 345 of the uppermost shoulder 340 of the slip assembly 300 contacts the top surface 245 of the uppermost shoulder 243 of the housing 200 to facilitate retraction of the of slip assembly 300 into the setback position. In one embodiment, the angle of the bottom surfaces 345 of the slip assembly 300 is substantially equal to the angle of the top surfaces 245 of the housing 200. In one embodiment, the angle of the bottom surface 345 may vary between each shoulder 340. In one embodiment, the angle of the top surface 245 may vary between each shoulder 243. In one embodiment, the angle of the slot 419 of the leveling ring 400 is substantially equal to the angle of the bottom surface 345 of the slip assembly 300. In one embodiment, the angle of the slot 419 of the leveling ring 400 is substantially equal to the angle of the top surfaces 245 of the shoulders 243. In one embodiment, the angle of the slot 419, the bottom surfaces 345 of the slip assembly, and/or the top surfaces of the shoulders 243 may include a range of about 40 degrees to about 50 degrees, a range of about 30 degrees to about 60 degrees, and/or a range of about 20 degrees to about 80 degrees.

In one embodiment, the slip assembly 300 is operable to travel a distance of about 5 inches from the setback position to the fully extended position. Each slip assembly 300 includes a setback distance of about 5 inches relative to the center of the spider 100, thereby providing a total setback distance of about 10 inches using opposing slip assemblies 300. The leveling ring 400 is coupled to each slip assembly 300 (as described herein) to allow a greater lateral or horizontal displacement of each slip assembly 300 relative to the longitudinal or vertical displacement of the leveling ring 400. In one embodiment, the spider 100 includes three slip assemblies 300 that are operable to provide a ten inch setback within the spider 100 to accommodate numerous tubular sizes having control lines clamped to the tubular, as well as other assorted downhole equipment. In one embodiment, the spider 100 is operable to provide about a 10 inch setback, while maintaining a total tool height of no more than about 37 inches. In one embodiment, the spider 100 is operable to provide about a 10 inch setback and is configurable within a 37½ inch rotary table.

Figure 5B:
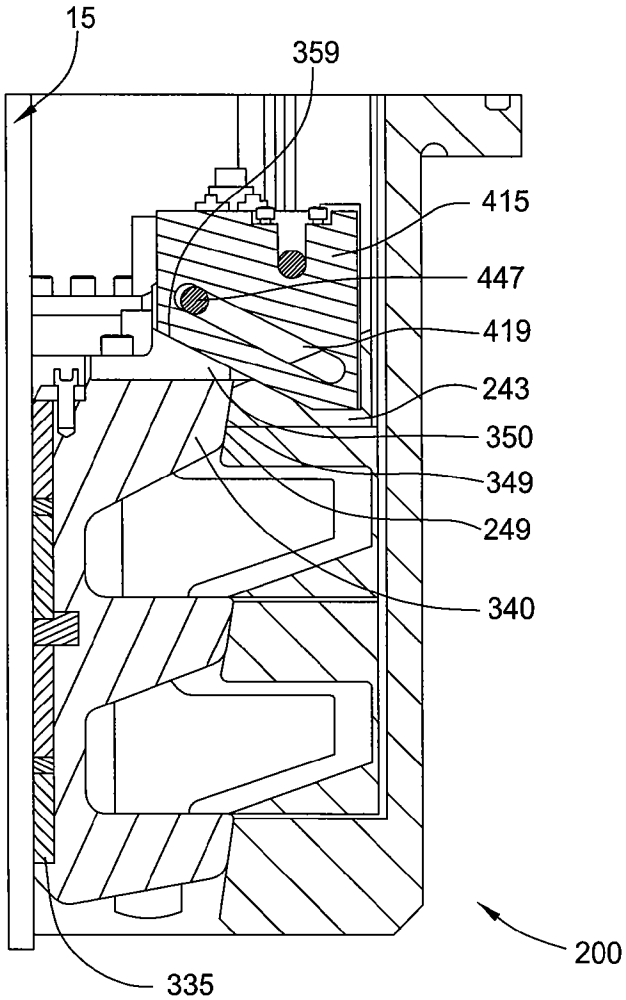
FIG. 5B illustrates the spider in a set position according to one embodiment of the invention.

FIG. 5B illustrates a cross sectional view of the spider 100 in the set position, located in the housing 200. As illustrated, the leveling ring 400 is lowered to about a lowermost point via the one or more rods 429. As the leveling ring 400 is lowered, the slip pin 447 is directed along and laterally displaced to the upper end of the slot 419 in the guide member 415 of the ring body 410, thereby laterally displacing the slip bracket 350 and projecting the slip assembly 300 radially outwardly to the set position. The bottom surface of the guide member 415 of the ring body 410 may slide along the surface of the channel 359 of the slip bracket 350 to transfer the load between the leveling ring 400 and the slip assembly 300. Resisting the movement of the slip pin 447 in this direction is the torsion spring 445, as described above, which is disposed around the spring rod 443 at one end and provides a positive force on the slip pin 447 to facilitate setting back of the slip assembly 300. As the slip assembly 300 is radially outwardly projected, the shoulders 340 of the slip assembly 300 slide down along the shoulders 243 of the bowl 240 of the housing 200. Starting from the setback position, the bottom surfaces 345 of the slip assembly 300 travel down the top surfaces 245 of the housing 200. At the ends of the shoulders 243, the shoulders 340 of the slip assembly 300 drop off of the top surfaces 245, thereby allowing the side surfaces 349 and 249 of the slip assembly 300 and the housing 200 to engage to further project the slip assembly 300 outwardly into the set position. Specifically, the side surfaces 349 of the shoulder 340 travel down along the side surfaces 249 of the shoulder 243. This additional engagement further helps increase the range of tubular sizes that the spider 100 may be used to grip and release. In the set position, the gripping elements 335, or dies, engage and grip the tubular 15 disposed through the spider 100.

In one embodiment, only the side surface 349 of the uppermost shoulder 340 of the slip assembly 300 contacts the side surface 249 of the uppermost shoulder 243 of the housing 200 to facilitate projection of the of slip assembly 300 into the set position. In one embodiment, the angle of the side surfaces 349 of the slip assembly 300 is substantially equal to the angle of the side surfaces 249 of the housing. In one embodiment, the angle of the side surfaces 345 may vary between each shoulder 340. In one embodiment, the angle of the top surfaces 245 may vary between each shoulder 243.

Figure 6:
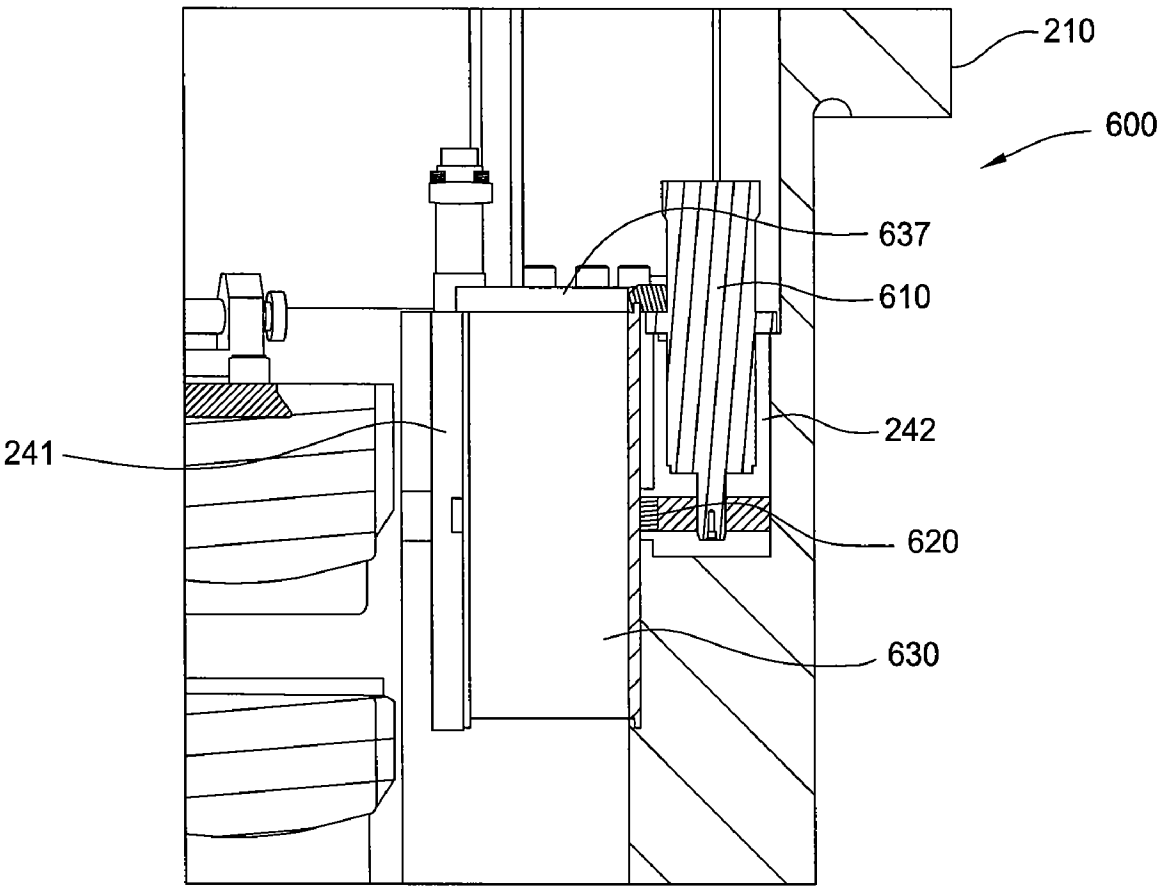
FIG. 6 illustrates a control line guide assembly of the spider according to one embodiment of the invention.
Figure 7A:
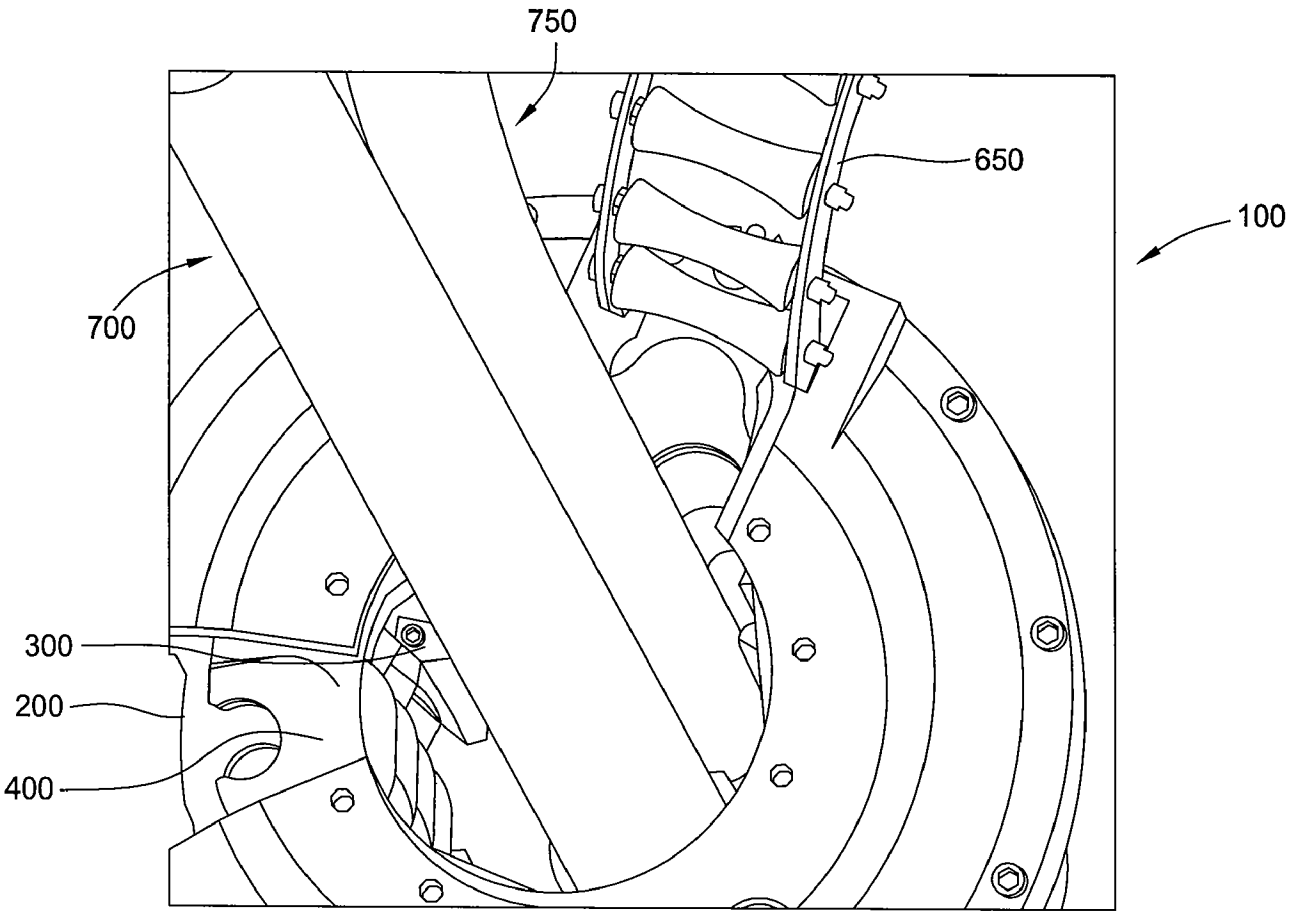
FIGS. 7A, 7B, 7C, and 7D illustrate operation of the spider according to one embodiment of the invention.
Figure 7B:
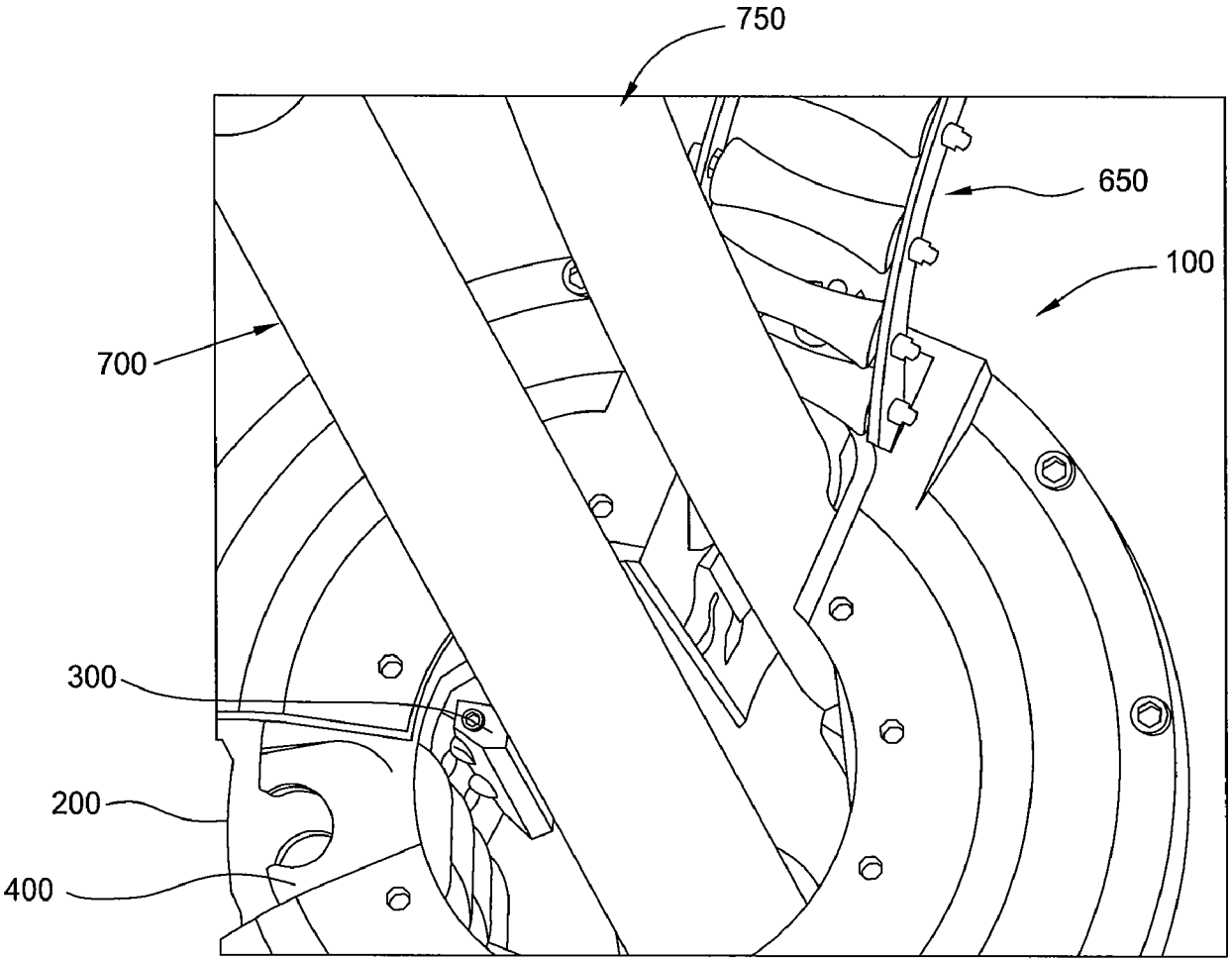
Figure 7C:
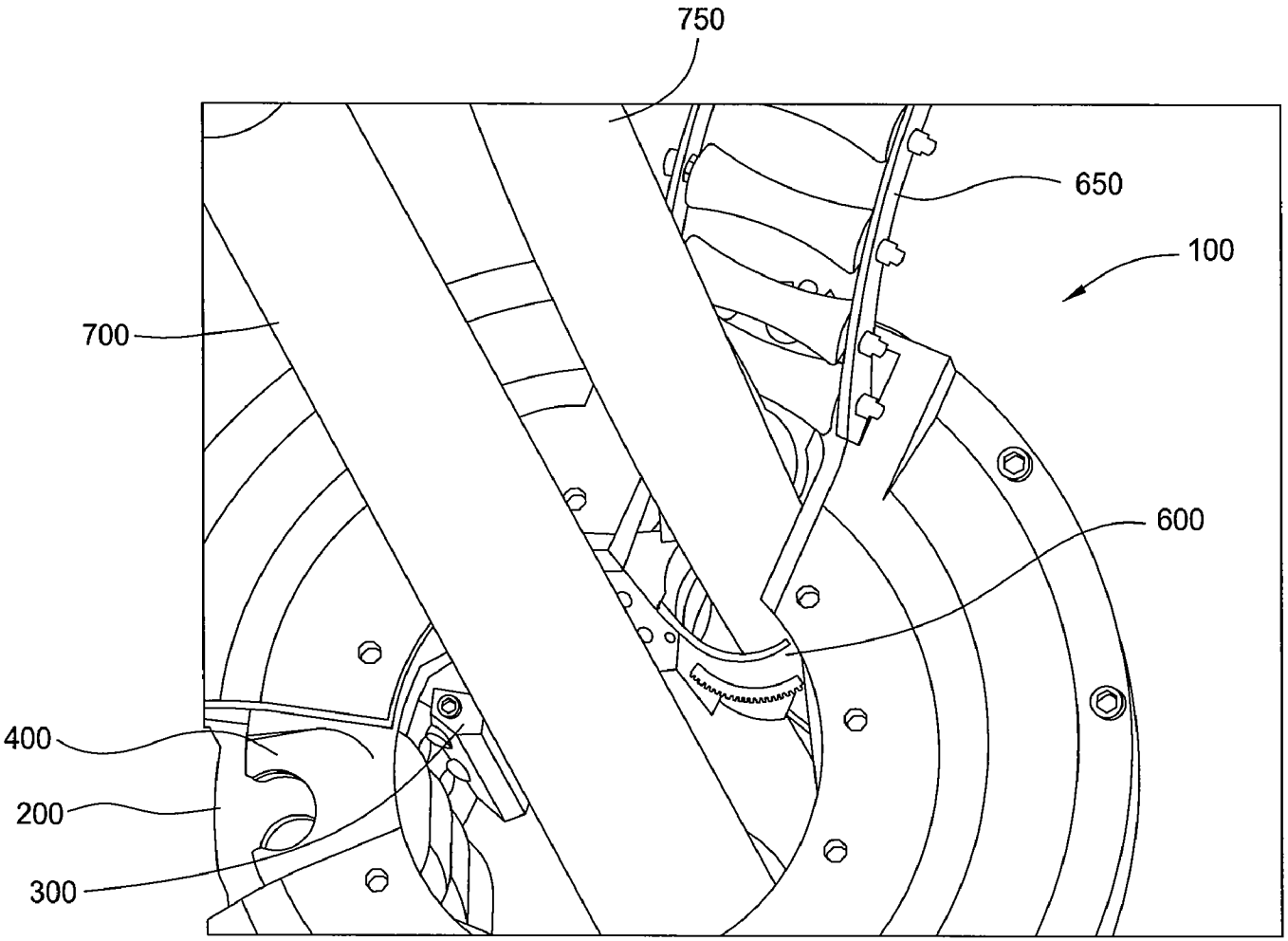
Figure 7D:
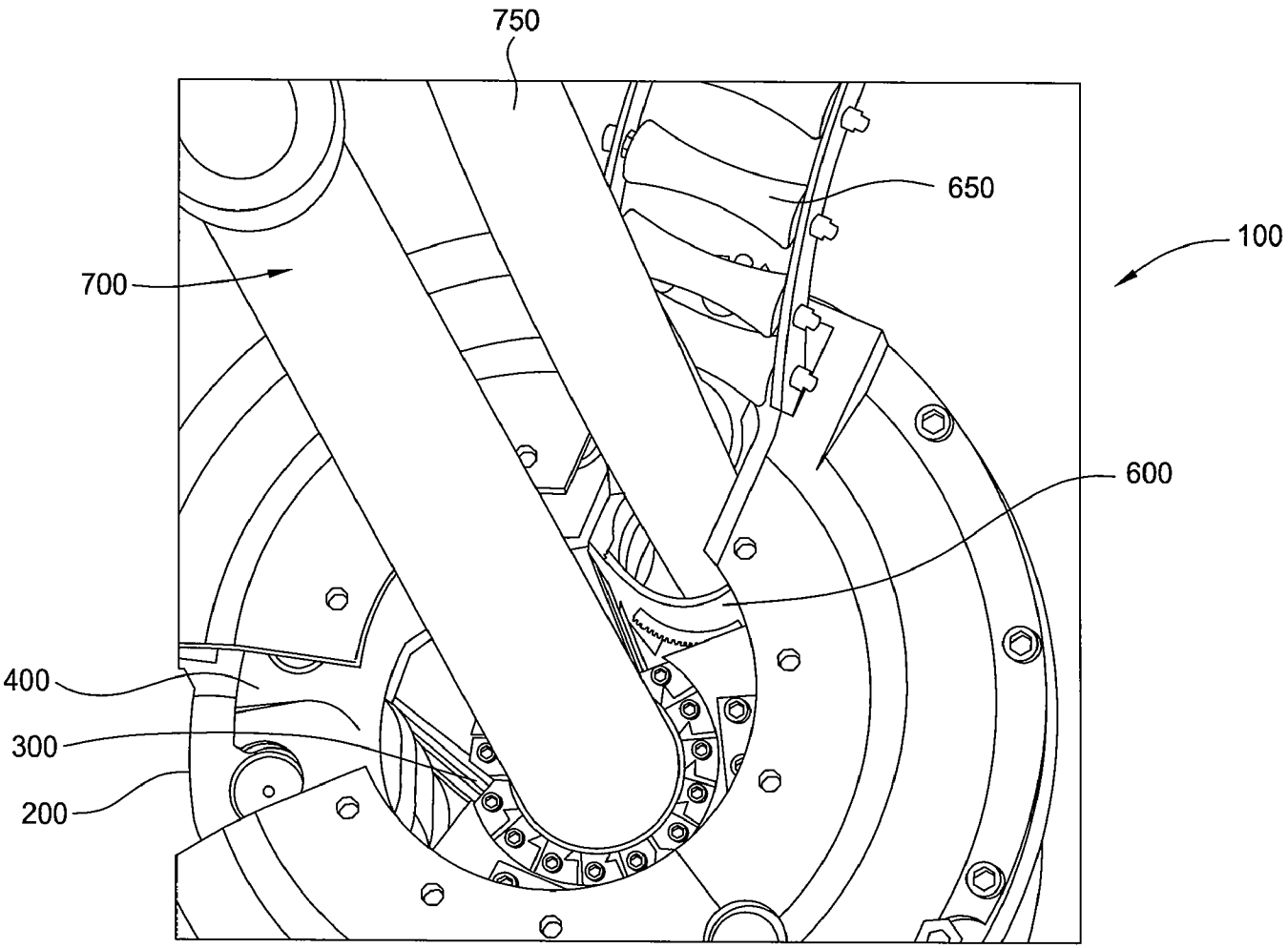

FIG. 6 illustrates a cross sectional view of the control line guide assembly 600 in the housing 200. As illustrated, the control line guide assembly 600 includes an actuator 610 disposed in the actuator slot 242 of the housing 200, a door 630 disposed around the control line recess 241 of the housing 200, a retention plate 637 for securing the door 630 around the control line recess 241 and the actuator 610 in the actuator slot 242, and a gear arrangement 620 coupled to the actuator 610 and the door 630. The actuator 610 comprises an electrical, mechanical, hydraulic, and/or any other type of actuator known to one of ordinary skill to provide actuation of the door 630. The door 630 may include a half cylindrical segment having a lip disposed at its lower end (illustrated at the lower right hand side of the partial cross section of the door 630) adapted to seat in a corresponding groove in the housing 200 to retain the door 630 around the control line recess 241 and in the housing 200. The door 630 is rotatable relative to the control line recess 241 to an open and closed position, to allow and prevent access to the control line recess 241. When in the open position, control lines may be introduced into the control line recess 241, away from the slip assembly 300. After the control lines are located in the control line recess 241, the door 630 may be closed to retain the control lines in the control line recess 241 and protect the control lines from damage that may be caused by the actuation of the slip assembly 300. The actuator 610 is operable to actuate the door 630 into the open and closed positions via the gear arrangement 620. In one embodiment, the gear arrangement 620 may include a gear track disposed on the outer surface of the door 630 that interlocks with a stationary spur gear coupled to the actuator 610. The actuator 610 may rotate the spur gear in a first direction, thereby rotating the door 630 into a first position, such as the open position, via the gear track. The actuator 610 may then rotate the spur gear in an opposite direction, thereby rotating the door 630 into a second position, such as the closed position, via the gear track.

In one embodiment, the slip assembly 300 may communicate with the control line guide assembly 600 in a manner that the slip assembly 300 may not operate if the door 630 of the control line guide assembly 600 is in the open position or any other intermediate position between the open and closed positions. In one embodiment, a control lock may be provided on the door 630 of the control line guide assembly 600 to prevent actuation of the slip assembly 600 when the door 630 is located in any particular position. In an optional embodiment, the spider 100 may include sensors operable to determine the relative position of door 630 of the control line guide assembly 600, the leveling ring 400, and/or the slip assembly 300. The sensors may also be operable to communicate these positions to facilitate the operation of the control line guide assembly 600, the leveling ring 400, and/or the slip assembly 300 to prevent premature activation of the control line guide assembly 600, the leveling ring 400, and/or the slip assembly 300 and to ensure efficient operation of the spider 100. For example, a sensor may be used to determine whether the door 630 of the control line guide assembly 600 is in the closed position, and such determination may be use to either allow or prevent the slip assembly 300 from activation.

FIGS. 7A-7D illustrate operation of the spider according to one embodiment. In operation, the spider 100 is flush mounted in a rotary table. Initially, the slip assembly 300 is in the retracted or setback position in the housing 200 and the control line guide assembly 600, specifically the door 630, is in the open position to receive a control line. A tubular 700 and a control line 750, such as an umbilical, are introduced through the spider 100. The control line 750 is directed to the control line recess 241 in the housing 200, either manually or by using an automated device, such as a mechanical arm disposed adjacent the spider 100. The control line support 650 may be used to support and guide the control line 750 through the spider 100 as it is introduced into or retrieved from a wellbore. Thereafter, the actuator 610 is actuated to close the door 630 to retain the control line 750 away from the slip assembly 300 and prevent the control line 750 from exiting the control line recess 241. After the tubular 700 is in the desired position in the spider 100 and the control line 750 is protected, a piston/cylinder arrangement may be used to actuate and set the slip assembly 300 into engagement with the tubular 700 as described above. Thereafter, a make up/break out operation may be performed. To release the slip assembly 300 from the tubular 700, the piston/cylinder arrangement may be actuated to retract or setback the slip assembly 300, thereby causing the slip assembly 300 to move radially away from the tubular 700. Finally, the control line guide assembly 600 may be actuated to the open position to release the control line 750.

In one embodiment, one or more piston/cylinder arrangements may be coupled to one or more rods 429 to move the leveling ring 400 and actuate the slip assembly 300. In one embodiment, one or more rods 429 may be actuated using electrical, mechanical, and/or hydraulic force. In one embodiment, the overall height of the spider 100 may be about 3 feet. In one embodiment, the spider 100 may be adapted to fit within a 37½ inch rotary table.

While the foregoing is directed to embodiments of the invention, other and further embodiments of the invention may be devised without departing from the basic scope thereof, and the scope thereof is determined by the claims that follow.

We claim:

1. A gripping apparatus for supporting a tubular, comprising:

a housing;

a slip assembly disposed in the housing;

a leveling ring operable to move the slip assembly in the housing; and a guide member and a mating member operable to couple the slip assembly to the leveling ring, wherein longitudinal movement of the leveling ring directs the mating member along the guide member to axially and radially displace the slip assembly relative to the housing, and wherein the guide member and the mating member include corresponding planar, inclined engagement surfaces for transmitting a force to actuate the slip assembly.

2. The apparatus of claim 1, wherein the guide member comprises a portion of the leveling ring that projects from a bottom surface of the leveling ring.

3. The apparatus of claim 1, wherein the guide member comprises a slot along which the mating member is directed.

4. The apparatus of claim 1, wherein the mating member comprises a slip pin.

5. The apparatus of claim 1, wherein the slip assembly comprises a slip bracket coupled to the guide member using the mating member.

6. The apparatus of claim 1, wherein the leveling ring comprises a biasing member coupled to the mating member to provide a constant force on the mating member in one direction.

7. The apparatus of claim 1, wherein the guide member comprises an angled slot and the mating member comprises a pin, and wherein downward movement of the leveling ring moves the pin up the angled slot.

8. The apparatus of claim 7, wherein upward movement of the leveling ring moves the pin down the angled slot.

9. The apparatus of claim 1, wherein when the leveling ring is lowered relative to the housing, the slip assembly is radially projected toward a center of the housing.

10. The apparatus of claim 1, wherein when the leveling ring is raised relative to the housing, the slip assembly is radially retracted from a center of the housing.

11. The apparatus of claim 1, wherein the housing comprises a shoulder projecting from an inner surface of the housing, wherein the slip assembly further comprises a shoulder movable along the shoulder of the housing.

12. The apparatus of claim 11, wherein longitudinal movement of the leveling ring moves the shoulder of the slip assembly along the shoulder of the housing.

13. The apparatus of claim 1, further comprising one or more rods coupled to the leveling ring to move the leveling ring in the longitudinal direction.

14. The apparatus of claim 1, further comprising a control line guide assembly disposed in the housing and operable to retain control lines from engagement with the slip assembly.

15. The apparatus of claim 14, further comprising a sensor operable to determine a position of the control line guide assembly and further operable to communicate the position to facilitate operation of the slip assembly.

16. A gripping apparatus for supporting a tubular, comprising:

a housing;

a slip assembly disposed in the housing and having a slip bracket to radially project and retract or extend the slip assembly relative to the housing; and a leveling ring having:

a slot and a pin, wherein the pin is disposed through the slot and the slip bracket, wherein vertical displacement of the leveling ring moves the pin along the slot and thereby moves the slip bracket radially relative to the housing; and corresponding planar, inclined engagement surfaces movable relative to each other to transmit a radial force to cause radial movement of the slip assembly.

17. The apparatus of claim 16, further comprising a control line guide assembly disposed in the housing adjacent the slip assembly and operable to retain control lines from engagement with the slip assembly.

18. The apparatus of claim 17, further comprising a sensor operable to determine a position of the control line guide assembly and further operable to communicate the position to facilitate operation of the slip assembly.

19. A gripping apparatus for supporting a tubular, comprising:

a housing;

a slip assembly disposed in the housing; and a guide member and a mating member operable to couple the slip assembly to the housing and including:

a coupling mechanism for coupling the mating member to the guide member for axial and radial displacement of the slip assembly relative to the housing; and corresponding planar, inclined engagement surfaces for transmitting a horizontal load to the slip assembly during actuation of the slip assembly.

20. The apparatus of claim 19, further comprising a leveling ring configured to move the slip assembly in the housing.

21. The apparatus of claim 20, wherein the housing comprises a shoulder having an incline along which the slip assembly travels, wherein the slip assembly travels a lateral distance that is greater than a longitudinal displacement of the leveling ring.

22. The apparatus of claim 21, wherein the coupling mechanism includes a slot in the guide member and a slip pin.

23. The apparatus of claim 19, wherein the coupling mechanism includes a slot in the guide member and a slip pin.

24. A method for supporting a tubular using a gripping apparatus, comprising:

providing a gripping apparatus having:

a housing, a slip assembly disposed in the housing, a leveling ring operable to actuate the slip assembly; and a guide member and a mating member operable to couple the slip assembly to the housing and including:

a coupling mechanism for coupling the mating member to the guide member and allowing relative movement between the mating member and the guide member; and corresponding engagement surfaces for transmitting a horizontal load to the slip assembly during actuation of the slip assembly;

positioning the tubular in the gripping apparatus;

longitudinally displacing the leveling ring relative to the housing to move the mating member relative to the guide member, thereby moving the slip assembly a lateral distance that is greater than the longitudinal displacement of the leveling ring;

transferring a horizontal load through the corresponding engagement surfaces to the slip assembly during longitudinal displacement of the leveling ring; and supporting the tubular using the slip assembly.

25. The method of claim 24, wherein the housing comprises a shoulder having an incline along which the slip assembly travels, wherein the slip assembly travels a lateral distance that is greater than a longitudinal displacement of the leveling ring.

26. The method of claim 24, wherein the coupling mechanism includes a slot in the guide member and a slip pin.

* * * * *